US007537403B2

(12) United States Patent
Ho et al.

(10) Patent No.: US 7,537,403 B2
(45) Date of Patent: May 26, 2009

(54) RIBBON CASSETTE

(75) Inventors: Hui-Chun Ho, Taipei (TW); Pany-Yen Jao, Taipei (TW); Wei-Chih Hung, Taipei (TW); Chao-Kuan Wu, Taipei (TW)

(73) Assignee: Lite-On Technology Corp., Taipei (TW)

( * ) Notice: Subject to any disclaimer, the term of this patent is extended or adjusted under 35 U.S.C. 154(b) by 288 days.

(21) Appl. No.: 11/557,072

(22) Filed: Nov. 6, 2006

(65) Prior Publication Data

US 2007/0243000 A1 Oct. 18, 2007

(30) Foreign Application Priority Data

Apr. 12, 2006 (TW) ..... 95206201 U

(51) Int. Cl.
*B41J 33/00* (2006.01)
*B41J 17/32* (2006.01)

(52) U.S. Cl. ..... 400/223; 400/207; 400/208; 400/208.1

(58) Field of Classification Search ..... 400/208, 400/693.1, 223, 207, 208.1
See application file for complete search history.

(56) References Cited

U.S. PATENT DOCUMENTS

| | | | | |
|---|---|---|---|---|
| 5,618,093 | A * | 4/1997 | Merle et al. | 353/26 R |
| 6,095,704 | A * | 8/2000 | Jaeger et al. | 400/613 |
| 2002/0098000 | A1 * | 7/2002 | Lau | 396/395 |

* cited by examiner

*Primary Examiner*—Daniel J Colilla
*Assistant Examiner*—Marissa L Ferguson-Samreth

(57) ABSTRACT

A ribbon cassette structure is provided. The provided ribbon cassette structure includes a cartridge having at least a rotating structure. The rotating structure includes a first actuating element, a first connecting element, a second actuating element and a support shaft. The first connecting element is located between the first actuating element and the second actuating element, and the second actuating element is located between the first actuating element and the support shaft.

18 Claims, 6 Drawing Sheets

RIBBON CASSETTE

FIELD OF THE INVENTION

The present invention relates to a ribbon cassette structure, and more particularly to the ribbon cassette structure capable of rotating along only a direction.

BACKGROUND OF THE INVENTION

People always try to detain the wonderful memories and the impressive grand sight via a camera, especially while the tempo of life is rapidly increasing. The digital camera needs no films and the user could review the pictures easily, so that the traditional camera is gradually superseded by the digital camera. In addition, since the computer technologies have been improved quickly, the computer has become a prerequisite equipment in the modern life and its powerful functions have brought us with lots of convenience and wonderful experiences.

Although the pictures stored in the digital camera could be reviewed with a display without the developing and printing steps, it is sometime still necessary to print out the pictures. If someone needs to print pictures out from the digital camera, he always needs to use the exclusive printer or connects the digital camera to a computer and then uses a common printer connected with the computer. Nevertheless, the feeding spool (and/or the take-up spool) of the ribbon cassette of the photo printer and the common printer could rotate in two-way, that is, the feeding spool (the supplying portion) and the take-up spool (the collection portion) are rotated in normal and reverse directions in response to reciprocal movement of the carriage. During the operation of the printers, if the ribbon is forced, it is possible that the used ribbon collected in the collection portion of the ribbon cassette would be rolled back and then be used again. In such a case, the printing quality of the picture would become really bad.

Please refer to FIG. 1, which is a diagram showing a ribbon cassette structure in the prior art. As illustrated in FIG. 1, the conventional ribbon cassette structure 1 includes a supplying portion 11 and a collection portion 12. The supplying portion 11 has a supplying roller 111 and the collection portion 12 has a collection roller 121. Both the supplying roller 111 and the collection roller 121 could rotate in two ways. Therefore, when the ribbon 13 is forced, the used ribbon 13 on the collection roller 121 might be rolled back to the supplying roller 111 and the printing quality of the following operation of printing would become bad. In order to overcome the defects resulting from the collection roller 121 capable of rotating in two ways, it might be a solution to design a torsion controller to control the rotating direction of the collection roller 121. Nevertheless, within the trends of the simplicity, compactness and easy-carrying, the dimensions of the conventional printers or photo printers have become smaller and the free spaces therein are limited. Due to the miniaturizations of the printers or photo printers, it would not be a good solution to add a torsion controller into the compact printers or photo printers to control the rotating direction of the collection roller 121. Furthermore, it would increase the cost of the printers or photo printers if a torsion controller is added. As above, it does not meet the current demand to add a torsion controller into the conventional printers or photo printers.

SUMMARY OF THE INVENTION

In accordance with one aspect of the present invention, a ribbon cassette structure is provided. The ribbon cassette structure includes a cartridge having a supplying portion with a supplying roller and a collection portion with a collection roller. The collection roller includes a first actuating element, a first connecting element, a second actuating element and a support shaft. The first connecting element is located between the first actuating element and the second actuating element, and the second actuating element is mounted between the first actuating element and the support shaft.

Preferably, the first connecting element provides one of elasticity and torsion to move the second actuating element.

Preferably, the support shaft has a first end facing to the second actuating element and a second end, wherein the first end has a gradient inward channel.

Preferably, the first actuating element has a socket.

Preferably, the second actuating element has a first portion and a second portion, wherein the first portion is joined with the first connecting element and mounted in the socket.

Preferably, the second portion of the second actuating element is mounted in the gradient inward channel.

Preferably, the gradient inward channel has a stop surface to stop the second actuating element through the second portion against the stop surface.

Preferably, the ribbon cassette structure further includes a first elastic element connected with the support shaft.

In accordance with another aspect of the present invention, a ribbon cassette structure is provided. The ribbon cassette structure includes a cartridge having a supplying portion having a supplying roller, and a collection portion having a collection roller. The supplying roller has a first actuating element, a first connecting element, a second actuating element and a support shaft. The first connecting element is located between the first actuating element and the second actuating element, and the second actuating element is mounted between the first actuating element and the support shaft.

Preferably, the first connecting element provides one of elasticity and torsion to move the second actuating element.

Preferably, the support shaft has a first end facing to the second actuating element and a second end, wherein the first end has a gradient inward channel.

Preferably, the first actuating element has a socket.

Preferably, the second actuating element has a first portion and a second portion, wherein the first portion is jointed with the first connecting element and mounted in the socket.

Preferably, the gradient inward channel has a stop surface to stop the second actuating element through the second portion against the stop surface.

In accordance with another aspect of the present invention, a ribbon cassette structure is provided. The ribbon cassette structure includes a cartridge having a supplying portion and a collection portion. The supplying portion and the collection portion rotate along a same single direction simultaneously, and each of the supplying portion and the collection portion includes a first actuating element, a first connecting element, a second actuating element and a support shaft. The first connecting element is mounted between the first actuating element and the second actuating element, and the second actuating element is mounted between the first actuating element and the support shaft.

Preferably, the first connecting element provides one of elasticity and torsion to move the second actuating element.

Preferably, the support shaft has a first end facing to the second actuating element and a second end, wherein the first end has a gradient inward channel.

Preferably, the first actuating element has a socket.

Preferably, the second actuating element has a first portion and a second portion, wherein the first portion is jointed with the first connecting element and mounted in the socket.

Preferably, the gradient inward channel has a stop surface to stop the second actuating element through the second portion against the stop surface.

The foregoing and other features and advantages of the present invention will be more clearly understood through the following descriptions with reference to the drawings, wherein:

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
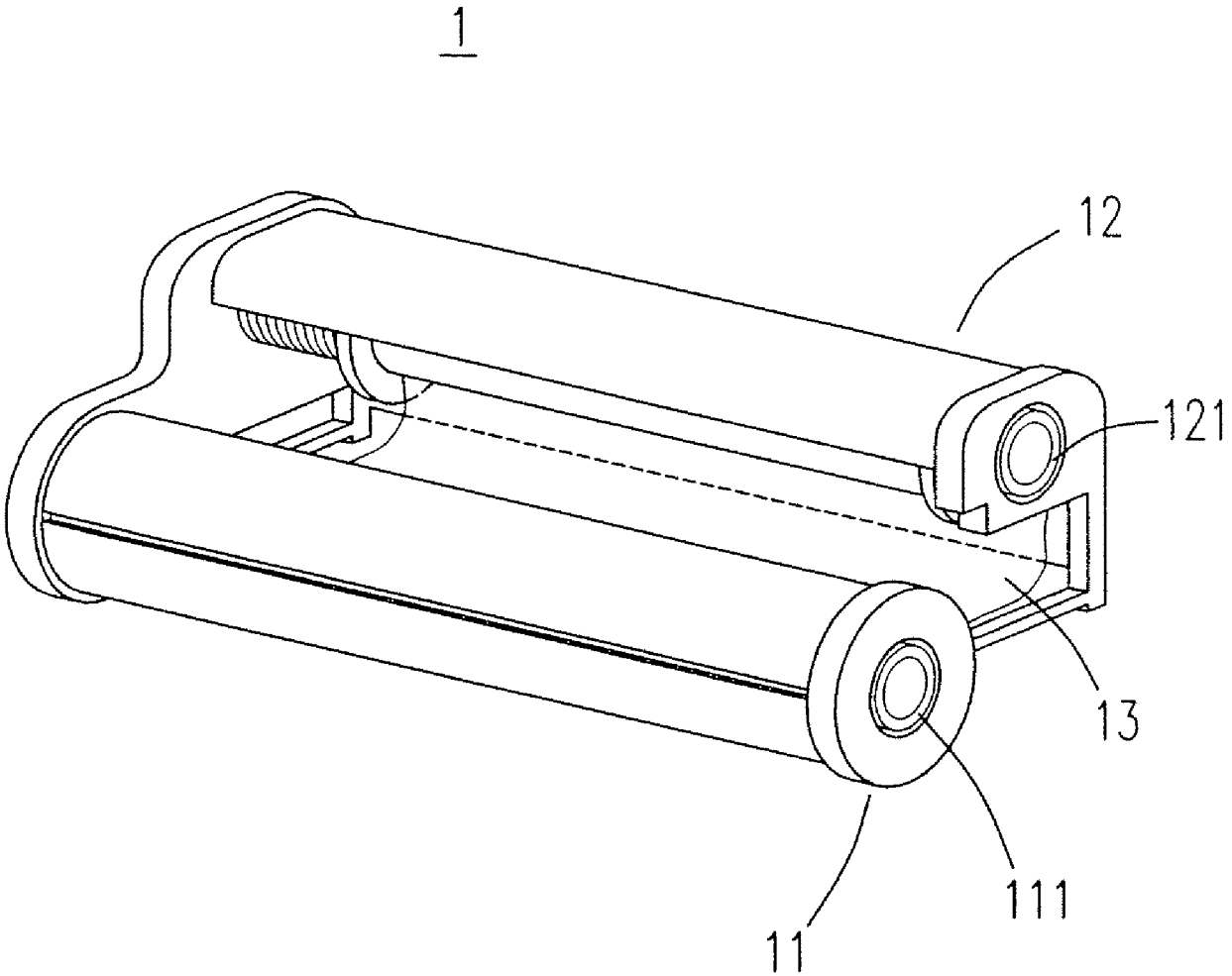
Fig. 1 (PRIOR ART)
FIG. 1 is a diagram showing a ribbon cassette structure according to the prior art.
Figure 2:
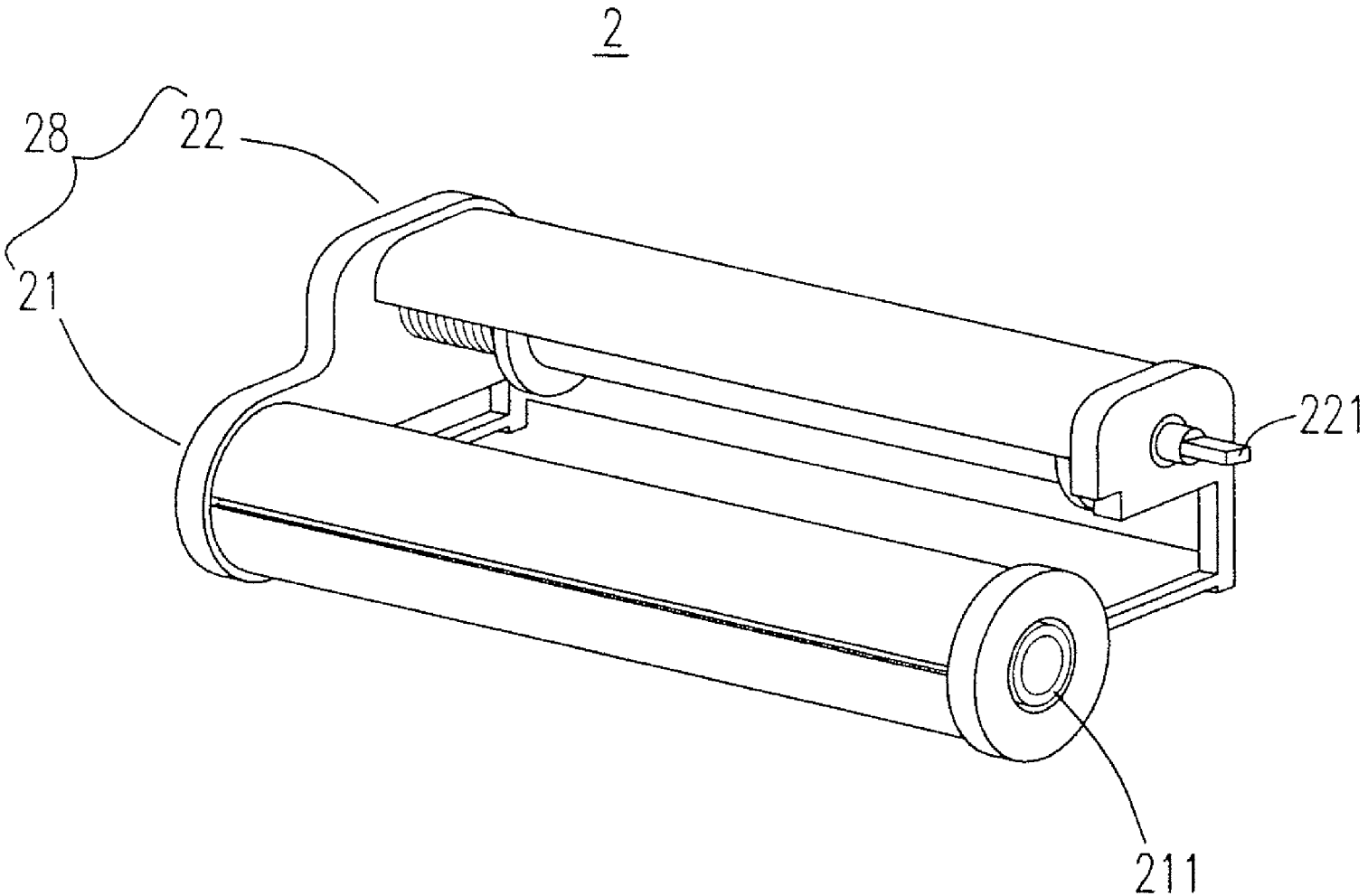
FIG. 2 is a diagram showing the ribbon cassette structure according to a first preferred embodiment of the present invention.

Please refer to FIG. 2, which shows the ribbon cassette structure according to a first preferred embodiment of the present invention. As shown in FIG. 2, the present ribbon cassette structure 2 includes a cartridge 28. The cartridge 28 includes a supplying portion 21 having a supplying roller 211, and a collection portion 22 having a collection roller 221. The collection roller 221 could rotate along a single direction rather than along two directions.

Figure 3:
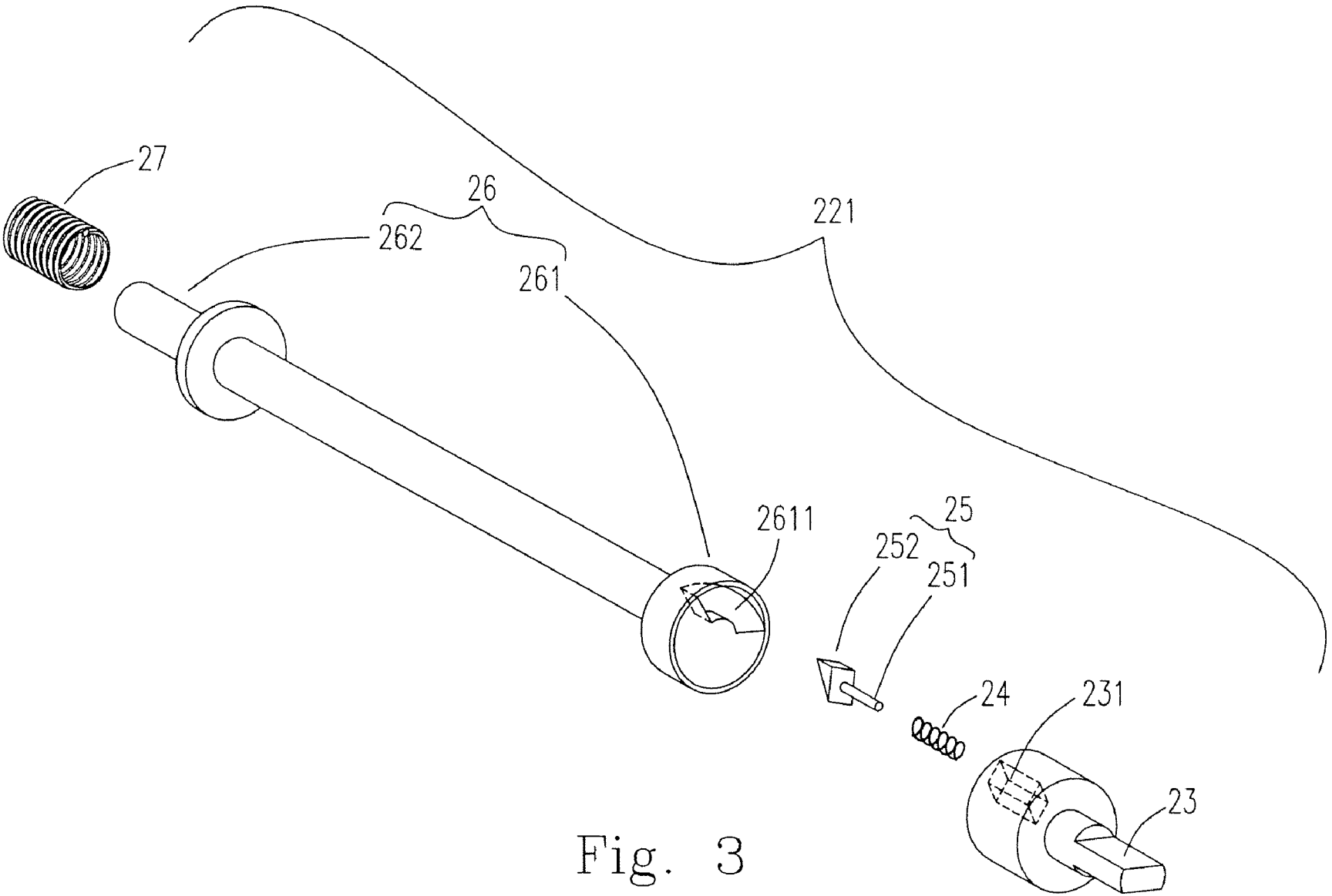
FIG. 3 is a diagram showing the collection roller of the ribbon cassette structure in FIG. 2.
Figure 4:
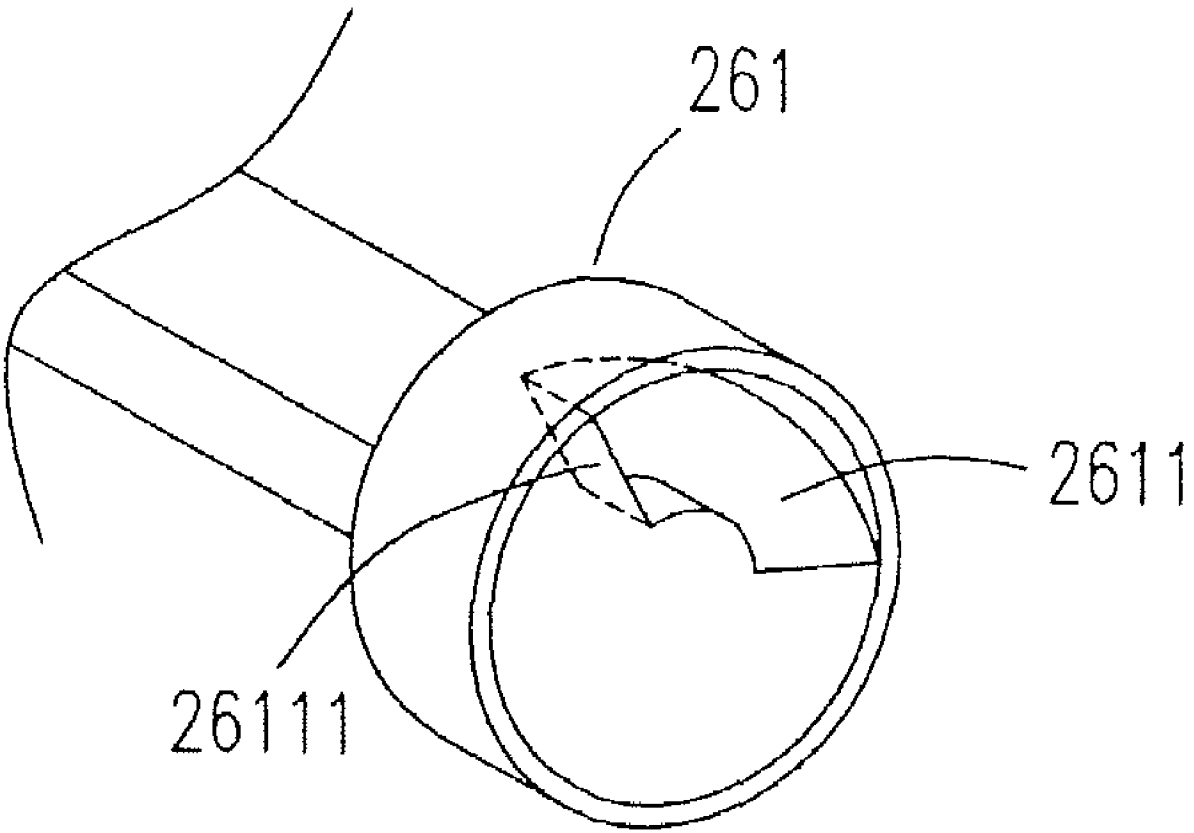
FIG. 4 is a diagram showing the first end of the support shaft according to the first embodiment of the present invention.

Please refer to FIG. 3, which shows the collection roller 221 of the collection portion 22 in FIG. 2. As shown in FIG. 3, the collection roller 221 includes a first actuating element 23, a first connecting element 24, a second actuating element 25, a support shaft 26 and a first elastic element 27. The first actuating element 23 includes a socket 231, and the support shaft 26 has a first end 261 facing to the second actuating element 25 and a second end 262 connected with the first elastic element 27. The first end 261 has a gradient inward channel 2611. In this embodiment, the gradient inward channel 2611 is designed in an anti-clockwise arrangement and gradually extended from the surface of the first end 261 to the inside of the support shaft 26. Also, the gradient inward channel 2611 has a stop surface 26111 (please refer to FIG. 4, which is a diagram showing the first end 261 of the support shaft 26 according to the first embodiment of the present invention). Nevertheless, it should be noted the gradient inward channel 2611 could be arranged in a clockwise arrangement in other embodiment. The second actuating element 25 has a first end 251 and a second end 252, wherein the second end 252 is configured as an incline shape to move along the gradient inward channel 2611. The socket 231 provides the moving space for the second actuating element 25 and the first connecting element 24, such as a spring, provides the elasticity and/or the torsion to move the second actuating element 25. The first elastic element 27 serves as a buffer. It is to be noted that, in other embodiments, the first connecting element 24 might be omitted.

During the process of assembling the collection roller 221, the first end 251 of the second actuating element 25 would be assembled with the first connecting element 24 and mounted within the socket 231, and the second end 252 of the second actuating element 25 is mounted within the gradient inward channel 2611 of the support shaft 26.

After the collection roller 221 is assembled, the first actuating element 23 might be able to move the second actuating element 25 along the anti-clockwise direction via the first connecting element 24 when the first actuating element 23 is forced by an anti-clockwise pressure; meanwhile, the second end 252 of the second actuating element 25 contacts with the gradient inward channel 2611 and slides into the inside of the support shaft 26 along the gradient inward channel 2611 by the elasticity and/or the torsion provided from the first connecting element 24. After the second end 252 of the second actuating element 25 is connecting with the stop surface 2611 of the gradient inward channel 2611, the support shaft 26 would be rotated anti-clockwise by the push from the second actuating element 25. As above, when the first actuating element 23 receives an anti-clockwise push, the collection roller 221 rotates anti-clockwise. On the other hand, when the first actuating element 23 receives a clockwise pressure and moves clockwise, the second actuating element 25 would rotate clockwise by the elasticity and/or torsion provided from the first connecting element 24. Nevertheless, during the process that the second actuating element 25 rotates clockwise, the second actuating element 25 would move out from the gradient inward channel 2611 and the support shaft 26 would not be moved due to no surface could receive the push from the second actuating element 25. Based on the first embodiment, the support shaft 26 cloud only rather rotate anti-clockwise than clockwise, i.e. the collection roller 221 rotates along a single direction rather than two directions. Since the collection roller 221 could rotate only along a single direction rather than two directions, it is easy to prevent the used ribbon collected in the collection portion 22 of the ribbon cassette structure 2 from being rolled back to the supplying portion 21 and be used again. In such a case, the printing quality of the picture could be controlled and maintained more completely.

Furthermore, it should be noted that if the gradient inward channel 2611 is arranged in a clockwise arrangement, and then the slope of the second end 252 of the second actuating element 25 should be changed to match the gradient inward channel 2611, so as to move along the gradient inward channel 2611 again when the first actuating element 23 is forced by a clockwise pressure. Nevertheless, in practice, the second end 252 of the second actuating element 25 could be in other shapes, such as the cube, the ladder-shape, the cone, the sphere and so on. Actually, the second end 252 of the second actuating element 25 could be any shape capable of driving the stop surface 26111 to drive the support shaft 26.

Figure 5:
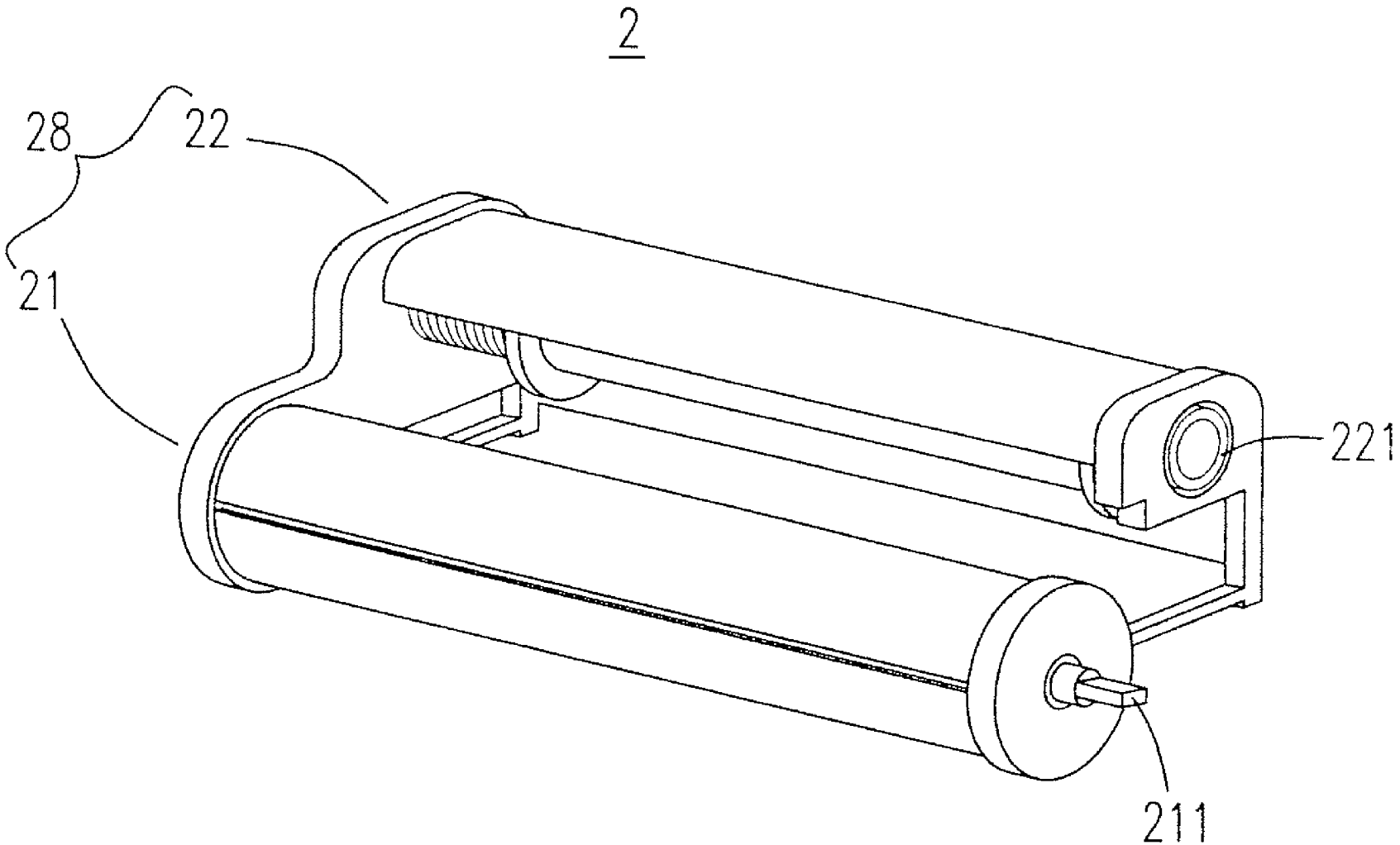
FIG. 5 is a diagram showing the ribbon cassette structure according to a second preferred embodiment of the present invention.
Figure 6:
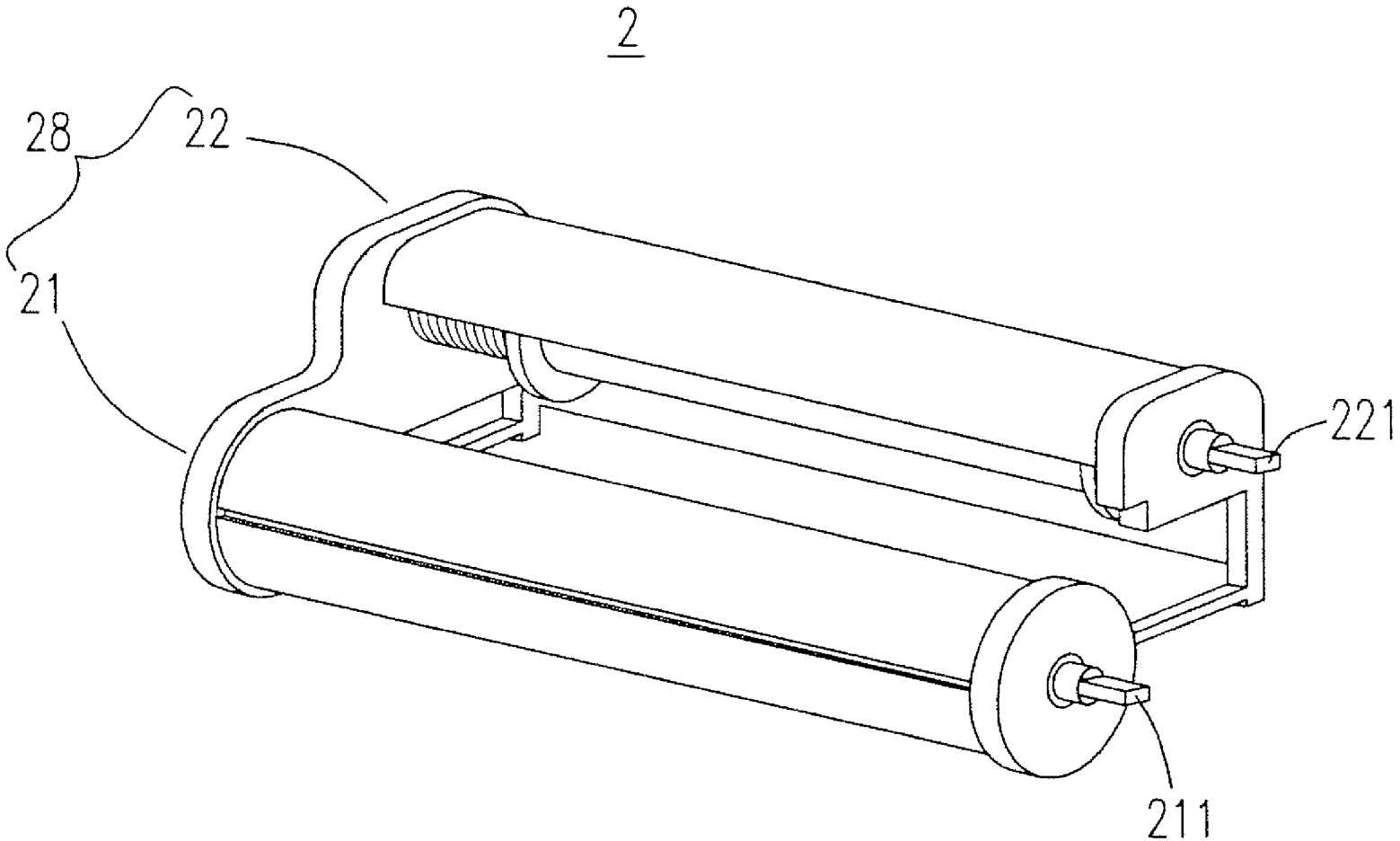
FIG. 6 is a diagram showing the ribbon cassette structure according to a third preferred embodiment of the present invention.

In addition, even though the first embodiment relates to the structure of the collection roller capable of rotating along a single direction rather than two directions, it should be noted that the similar structure could be applied to the supplying roller, such as the second embodiment shown in FIG. 5, or to the collection and supplying rollers simultaneously, such as the third embodiment shown in FIG. 6.

As above, the above embodiments provide ribbon cassette structures formed by applying the incline principle and the specific geometric arrangements of the actuating elements and the elastic elements. During the operation of the ribbon cassette structure provided in this invention, since the actuating element could only cause the relevant roller to rotate along a specific single direction (only the supplying roller is rotated along a specific direction, or only the collection roller is rotated along a specific direction, or both the supplying and collection rollers are rotated along a same single direction), the used ribbon would not be rolled back and used again while the ribbon is forced by a undesired force. Accordingly, the provided ribbon cassette structure could effectively avoid the possibility of that the ribbon is repeatedly used in the conventional ribbon cassette structure and provide a better and more stable printing quality. In addition, the provided ribbon cassette structure could be easily assembled with the various conventional printers or photo printers by a simple cam combination, a gear combination or other simple mechanical combination, so that the cost for providing new torsion controller into the photo printer or printer can be avoided. Furthermore, since no torsion controller is necessary, the provided ribbon cassette structure also conforms to the trends of the simplicity, compactness, easy-carrying and miniaturization.

As above, it should be easily understood for one skilled in the art that the provided ribbon cassette structure of the present invention could not only avoid the conventional defect that the used ribbon being rolled back and re-used but also save the cost of adding a torsion controller and conform with the trends of the simplicity, compactness, easy-carrying, and miniaturization. Furthermore, the provided ribbon cassette structure could be applied to various printers or other printing devices, such as photo printers. Accordingly, the provided ribbon cassette structure of the present invention has the novelty, progressiveness and industrial application.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claim is:

1. A ribbon cassette structure, comprising:

a cartridge comprising:

a supplying portion having a supplying roller; and a collection portion having a collection roller, wherein the collection roller comprises a first actuating element, a first connecting element, a second actuating element and a support shaft, having a first end facing the second actuating element and a second end, the first end has a gradient inward channel, the first connecting element is located between the first actuating element and the second actuating element, and the second actuating element is located between the first actuating element and the support shaft.

2. A ribbon cassette structure as claimed in claim 1, wherein the first connecting element provides one of elasticity and torsion to move the second actuating element.

3. A ribbon cassette structure as claimed in claim 1, wherein the gradient inward channel gradually extended from a surface of the first end to the inside of the support shaft.

4. A ribbon cassette structure as claimed in claim 1, wherein the first actuating element has a socket.

5. A ribbon cassette structure as claimed in claim 4, wherein the second actuating element has a first end and a second end, and the first end and the first connecting element are jointed with each other and mounted into the socket.

6. A ribbon cassette structure as claimed in claim 5, wherein the second end of the second actuating element is mounted in the gradient inward channel.

7. A ribbon cassette structure as claimed in claim 6, wherein the gradient inward channel has a stop surface to stop the second actuating element when the second end of the second actuation element is contacting with the stop surface.

8. A ribbon cassette structure as claimed in claim 1 further comprising a first elastic element connected with the support shaft.

9. A ribbon cassette structure, comprising:

a cartridge comprising:

a supplying portion having a supplying roller; and a collection portion having a collection roller, wherein the supplying roller comprises a first actuating element, a first connecting element, a second actuating element and a support shaft having a first end facing the second actuating element and a second end, the first end has a gradient inward channel, the first connecting element is located between the first actuating element and the second actuating element, and the second actuating element is located between the first actuating element and the support shaft.

10. A ribbon cassette structure as claimed in claim 9, wherein the first connecting element provides one of elasticity and torsion to move the second actuating element.

11. A ribbon cassette structure as claimed in claim 9, wherein the first actuating element has a socket.

12. A ribbon cassette structure as claimed in claim 11, wherein the second actuating element has a first end and a second end, and the first end and the first connecting element are jointed with each other and mounted into the socket.

13. A ribbon cassette structure as claimed in claim 12, wherein the gradient inward channel has a stop surface to stop the second actuating element when the second end of the second actuation element is contacting with the stop surface.

14. A ribbon cassette structure, comprising:

a cartridge having a supplying portion and a collection portion, wherein the supplying portion and the collection portion rotate along a same single direction simultaneously, and each of the supplying portion and the collection portion comprises a first actuating element, a first connecting element, a second actuating element and a support shaft having a first end facing the second actuating element and a second end, and the first end has a gradient inward channel, wherein the first connecting element is located between the first actuating element and the second actuating element, and the second actuating element is located between the first actuating element and the support shaft.

15. A ribbon cassette structure as claimed in claim 14, wherein the first connecting element provides one of elasticity and torsion to move the second actuating element.

16. A ribbon cassette structure as claimed in claim 14, wherein the first actuating element has a socket.

17. A ribbon cassette structure as claimed in claim 16, wherein the second actuating element has a first end and a second end, and the first end and the first connecting element are jointed with each other and mounted into the socket.

18. A ribbon cassette structure as claimed in claim 17, wherein the gradient inward channel has a stop surface to stop the second actuating element when the second end of the second actuation element is contacting with the stop surface.

* * * * *